US007144256B2

(12) United States Patent
Pabst et al.

(10) Patent No.: US 7,144,256 B2
(45) Date of Patent: Dec. 5, 2006

(54) CONNECTOR ARRANGEMENT BETWEEN A FLEXIBLE RIBBON CABLE AND A COMPONENT

(75) Inventors: Thomas Bernhard Pabst, Röthenbach a.d. Pegnitz (DE); Hans-Otto Geltsch, Berg-Sindlbach (DE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/532,838

(22) PCT Filed: Oct. 29, 2003

(86) PCT No.: PCT/EP03/12004

§ 371 (c)(1),
(2), (4) Date: Apr. 19, 2005

(87) PCT Pub. No.: WO2004/040712

PCT Pub. Date: May 13, 2004

(65) Prior Publication Data

US 2006/0035515 A1 Feb. 16, 2006

(30) Foreign Application Priority Data

Oct. 31, 2002 (DE) ..... 102 50 933

(51) Int. Cl.
*H01R 12/00* (2006.01)

(52) U.S. Cl. ..... 439/67

(58) Field of Classification Search ..... 439/67, 439/329, 495, 354, 358, 499, 328
See application file for complete search history.

(56) References Cited

U.S. PATENT DOCUMENTS

| | | | | |
|---|---|---|---|---|
| 4,252,392 | A | 2/1981 | Whiteman, Jr. | 339/74 |
| 4,740,867 | A * | 4/1988 | Roberts et al. | 361/749 |
| 5,015,197 | A * | 5/1991 | Redmond et al. | 439/329 |
| 5,297,968 | A | 3/1994 | Johnson et al. | 439/67 |
| 6,010,359 | A * | 1/2000 | Etters et al. | 439/496 |
| 6,773,288 | B1 * | 8/2004 | Geltsch et al. | 439/329 |
| 6,780,046 | B1 * | 8/2004 | Bach et al. | 439/495 |
| 6,949,316 | B1 * | 9/2005 | Aoki | 439/260 |

FOREIGN PATENT DOCUMENTS

| | | |
|---|---|---|
| DE | 1 920 988 | 11/1970 |
| DE | 101 115 283 C1 | 3/2001 |
| EP | 0 339 701 | 11/1989 |
| EP | 0 443 655 A1 | 8/1991 |
| EP | 0 509 380 A2 | 10/1992 |
| EP | 1 150 384 A2 | 10/2001 |
| EP | 1 154 524 A1 | 11/2001 |

* cited by examiner

*Primary Examiner*—Phuong Dinh
(74) *Attorney, Agent, or Firm*—Harrington & Smith, LLP

(57) ABSTRACT

The invention relates to a connector arrangement, between a flexible ribbon cable (1) and a component (5) of an electrical circuit, whereby the flexible ribbon cable (1) has a stripped conductor region on one side of the end for connection, comprising a housing (2) in which the flexible ribbon cable end is clamped and in which an elastic element (3) subjects the stripped end to pressure. The component (5) comprises a socket (4) for the housing (2), in which the housing (2) may be clipped and with contact strips (6) arranged therein against which the stripped regions of the flexible ribbon cable (1) are pressed, when the housing (2) is in the terminal position thereof within the socket (4).

19 Claims, 2 Drawing Sheets

CONNECTOR ARRANGEMENT BETWEEN A FLEXIBLE RIBBON CABLE AND A COMPONENT

FIELD OF THE INVENTION

The present invention refers to a connector arrangement between a flat flex cable and a component of an electrical circuit in accordance with the preamble of patent claim 1. Such a connector arrangement is known from EP 0443655 A1.

BACKGROUND OF THE INVENTION

Flat flex cables are finding ever-increasing application in bus systems—for example, in automobile manufacture. There, flat flex cables, which are connected to form ring circuits and by means of which a multiplex control of diverse components occurs, replace costly and, in particular, heavy-weight cable harnesses.

Known from EP 0 2 006 691 is a connector arrangement for flat flex cables by means of which two such ribbon cables are connected to each other. For this purpose, respective conductor strands are stripped of insulation at the connecting site between the ribbon cables and these sites are pressed together by a clamp under application of an elastic pressure.

SUMMARY OF THE INVENTION

This simple method of connection has proven itself useful, but can be applied only to a connection of flat flex cables placed under one another.

The present invention is based on the problem of further developing a generic connector arrangement in such a way that, with it, flat flex cables can be manufactured with circuit boards as well.

This problem is solved in accordance with the claims.

Characterized in the subclaims are features of preferred embodiments of the present invention. The present invention is based on the basic idea of affixing a housing to the cable ends of the connecting flexible ribbons, in which the region that is to be contacted is subjected to an elastic spring force, by means of which this region is pressed against the contact surfaces of a mating plug in such a way that the housing is pressed on the latter via an uptake in the region of the mating contact.

BRIEF DESCRIPTION OF THE DRAWINGS

The invention will be described in greater detail below on the basis of the description of two embodiment examples with reference to the drawing. Shown therein is the following.

DETAILED DESCRIPTION OF THE INVENTION

Figure 1:
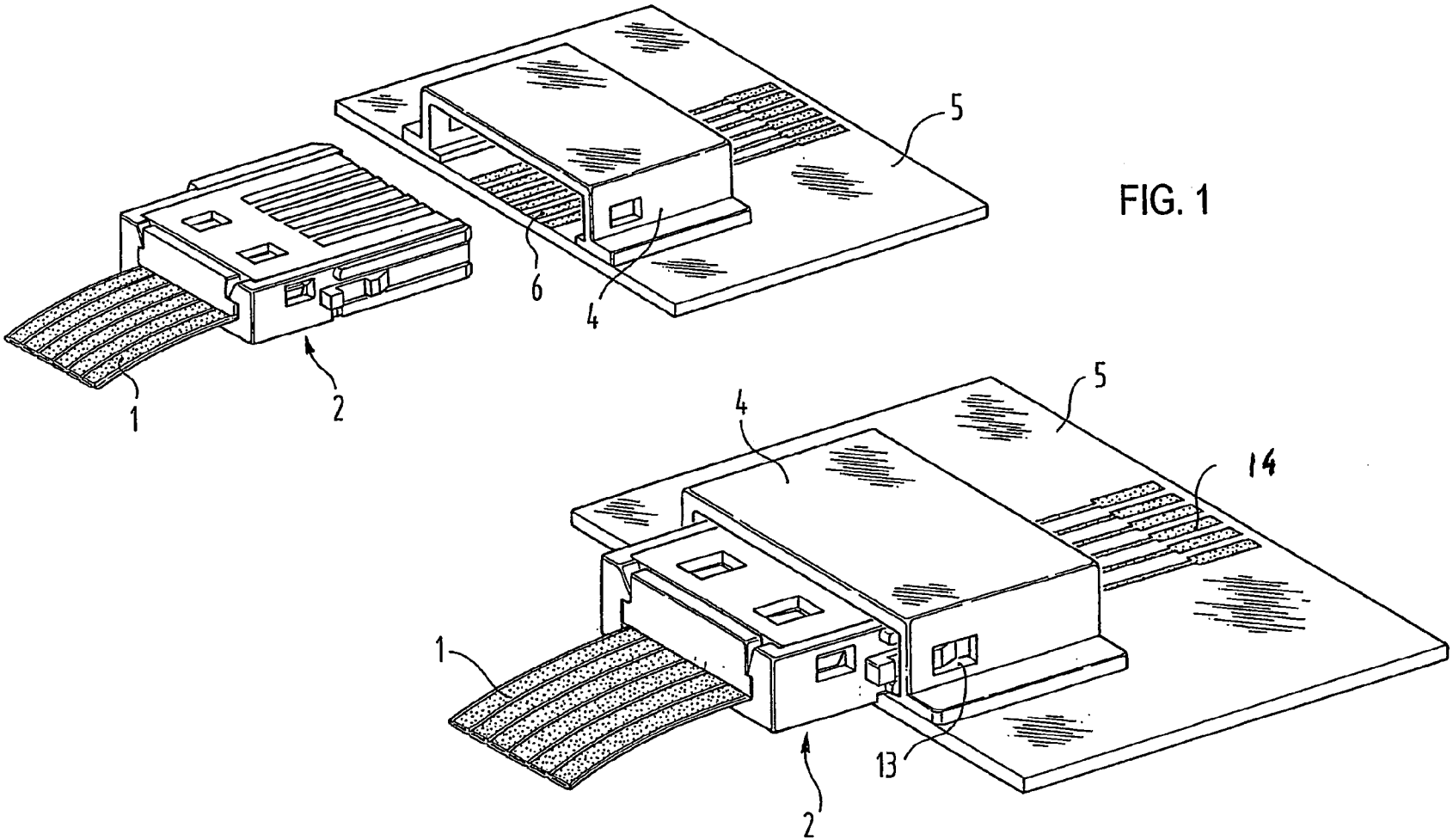
FIG. 1 shows a first embodiment example of a connector arrangement of the invention prior to connection and in contacted position.

FIG. 1, top left, shows a flat flex cable 1, to the front end of which a housing 2 is attached. The housing 2 has an opening on its bottom, which is not visible here, through which regions of the flat flex cable 1 stripped of insulation protrude downward above the floor of the housing 2. An electrical component, a circuit board 5 in the example shown here, has conductive tracks 14 with contact surfaces 6. An uptake 4 is attached to the circuit board 5 above these contact surfaces 6 by, for example, adhesive bonding. This uptake 4 has the form of a wide bracket that extends over the contact surfaces 6. The housing 2 is inserted into the empty space between the contact surfaces 6 and the upper cross wall of the bracket. This operation is shown in FIG. 1, bottom right. In its final position, the housing 2 is locked in the uptake 4 by catch arms that are affixed to the sides walls of the housing and that spring into a catch opening 13.

Figure 2:
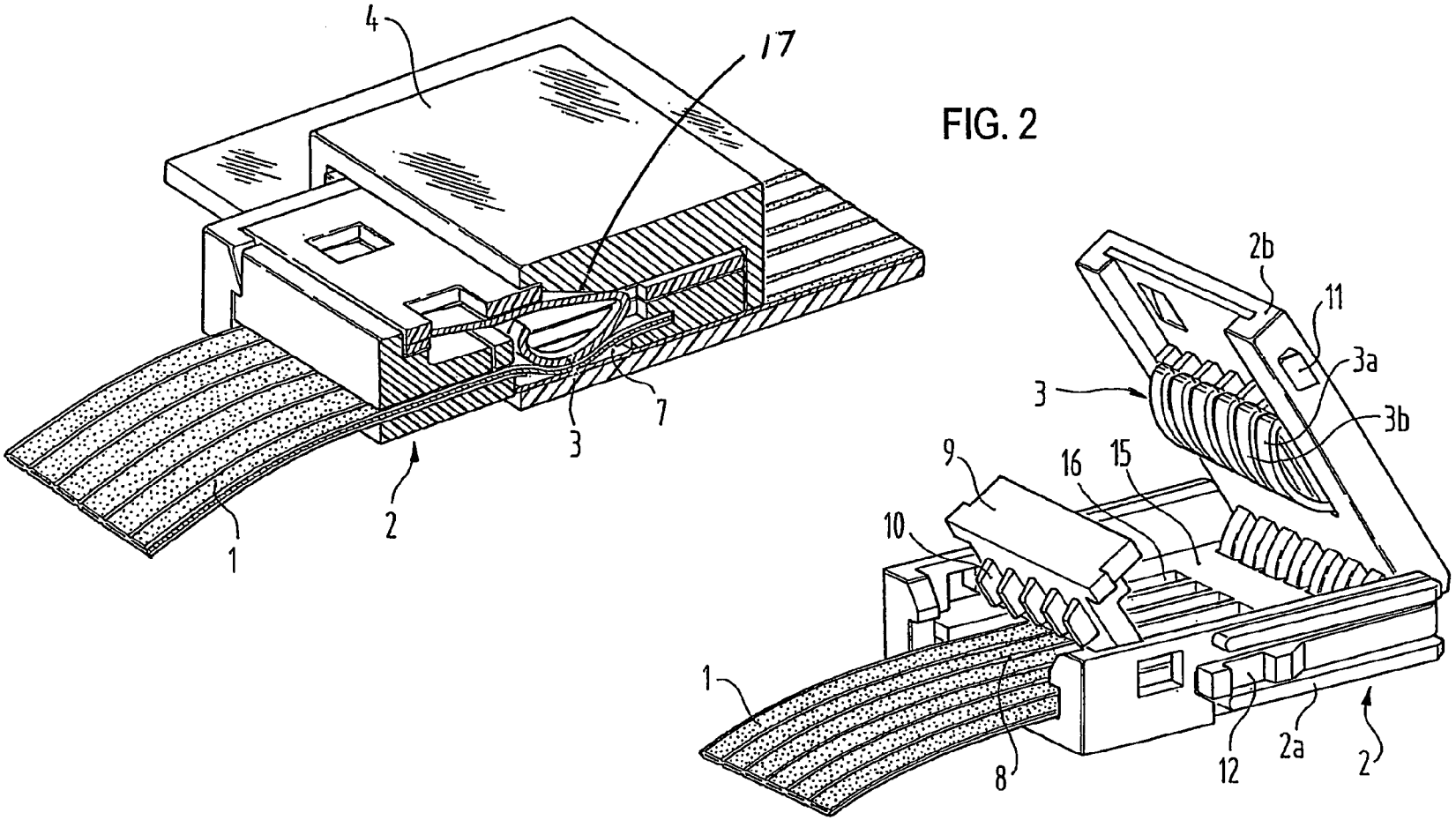
FIG. 2 shows the connector arrangement in perspective, partially cut away and in opened position.

FIG. 2, top left, shows the final position of the housing 2 in the uptake 4, partially cut away. Evident there is also the fact that the uptake 4 can also be closed on its front side. Attached to the inside of the housing 2 is a steel spring 3, the free end of which is bent back in a convex manner in a direction opposite to the plugging direction, so that, in the region of an opening 7 in the floor of the housing 2, the bulging region of the steel spring 3 presses on the flat flex cable 1 and the latter, with its conductive tracks that have been stripped of insulation in this region, presses through the opening 7 until these regions protrude above the floor.

When the housing 2 is inserted into the uptake 4, the pressing force exerted by the steel spring 3 is at first relatively small. Only toward the end of the motion of insertion does the back side of each steel spring 3 contact a ramp 17 that is constructed on the uptake and that bends the steel spring 3 further downward and thus produces the requisite contact force. In this way, an initially small insertion force and a lower wear due to friction against the contact surface is achieved. As can be seen in FIG. 1, it is possible to provide one opening per spring through which the spring is pressed by the one ramp for each steel spring 3; however, it is also possible to provide one ramp and one opening for all steel springs.

Shown in FIG. 2, bottom right, is the opened housing 2. The housing 2 consists of a bottom part 2*a*, into which the insertion end of the flat flex cable is inserted. The cable end has perforations 8 in defined relative positions with respect to the head end of the flat flex cable 1, in which the retaining pins 10 of a strain relief 9 engage. The latter is hinged to the body of the bottom part 2*a* of the housing 2 transverse to the lengthwise direction of the ribbon cable and can be pivoted after insertion of the flat flex cable 1 into the housing 2, thereby allowing the retaining pins 10 to engage in the perforations 8. In this position, the strain relief 9 is locked on the side flanks of the bottom part 2*a* of the housing 2. The top part 2*b* of the housing 2 is hinged in a pivoting manner to the front end of the bottom part 2*a* of the housing 2. The steel spring 3 is also attached in the top part. In the example shown here, the steel spring 3 takes the form of a comb; that is, a number of spring steel strips 3*a*, 3*b*, . . . , corresponding to the number of conductive tracks, are arranged parallel to one another, so that each conductive track being connected is subject individually to the pressure of its own steel strip spring. The guiding of the individual spring strips is achieved in the embodiment example shown by way of ribs arranged between them and by an intermediate plate 15 with slots 16, into which the spring arches of the individual spring strips 3*a*, 3*b* can dip during pivoted closure of the top housing part 2*b* and are laterally guided. The top part 2*b* of the housing 2 is also locked in the bottom part 2*a* via catches 11 and corresponding catch shoulders. The housing 2 is guided through the uptake 4 with little play, so that the exposed conductor regions are pressed on corresponding contact surfaces 6 of the circuit board shown in FIG. 1 owing to an elastic spring force. A simple and secure contacting is ensured in this way.

The description of this embodiment example of the present invention serves only for purposes of illustration and is not to be understood as being limiting.

The invention claimed is:

1. A connector arrangement between a flat flex cable and a component of an electrical circuit, wherein the flat flex cable has conductor regions stripped of insulation on only one side of its end being connected, comprising a housing in which the end of the flat flex cable is clamped and in which an elastic element subjects the stripped regions to pressure, the component comprising an uptake for the housing, in which the housing can be locked and in which contact tracks are arranged, against which the stripped regions of the flat flex cable are pressed when the housing is in the final position thereof in the uptake, characterized in that the component is an electrical circuit board and the uptake forms a bracket, which is attached to the circuit board above an arrangement of conductive tracks and the housing is guided laterally and perpendicularly with respect to the circuit board, wherein the housing has a bottom part with at least one opening in the floor, through which the regions of the flat flex cable stripped of insulation can be pressed, and a top part, attached to the bottom part, which has the spring elements opposite the opening, with which the flat flex cable is subjected to pressure.

2. The connector arrangement according to claim 1, further characterized in that the flat flex cable has perforations on its end that is introduced into the housing, in which a strain relief with retaining pins, which is hinged on the bottom housing part, engages in a lockable manner.

3. The connector arrangement according to claim 1, further characterized in that the elastic element consists of one or more steel leaf springs.

4. The connector arrangement according to claim 1, further characterized in that the top housing part is hinged on its front side to the bottom housing part and can be locked in place via catch hooks on the bottom housing part.

5. The connector arrangement according to claim 1, further characterized in that the housing can be locked in place via catch arms in catch openings on the side walls of the bracket.

6. The connector arrangement according to claim 1, further characterized in that, on the top inner side of the uptake, there is constructed at least one ramp, which presses, through at least one opening in the top side of the housing, all or individual steel springs downward on the flat flex cable stripped of insulation.

7. A connector arrangement between a flat flex cable and an electrical component, the connector arrangement comprising:

a first housing connected to an end of the flat flex cable;

at least one elastic element connected to the first housing; and a second housing connected to the electrical component and having at least a portion of the first housing removably connected therein, wherein the flat flex cable comprises a plurality of conductors and electrical insulation surrounding and separating the conductors, wherein the end of the flat flex cable comprises stripped regions having the electrical insulation removed from the conductors on a first side of the flat flex cable at the stripped regions, wherein the at least one elastic element is located against an opposite second side of the end of the cable and presses the stripped regions into contact with electrical contact surfaces of the electrical component in an area at least partially bounded by the second housing, wherein the first housing comprises a bottom part and a top part, wherein the at least one elastic element is connected to the top part, and wherein the top part is pivotably connected to the bottom part.

8. A connector arrangement as in claim 7 wherein the at least one elastic element comprises a metal spring.

9. A connector arrangement as in claim 8 wherein the metal spring has a form of a comb with spring steel strips parallel to one another.

10. A connector arrangement as in claim 7 wherein the at least one elastic element comprises a plurality of metal springs, each spring pressing against the insulation on the second side of the cable directly opposite one of the stripped regions.

11. A connector arrangement as in claim 7 wherein the at least one elastic element comprises a bent back free end.

12. A connector arrangement as in claim 7 wherein the electrical insulation of the cable has perforations, and the first housing has retaining pins located in the perforations which form a strain relief.

13. A connector arrangement as in claim 7 wherein the at least one elastic element is directly contacted by the second housing.

14. A connector arrangement as in claim 13 wherein, when the first housing and the at least one elastic element are inserted into the second housing, at an end of insertion the at least one elastic element contacts a ramp on the second housing to press the at least one elastic element against the flat flex cable.

15. Electrical connection components comprising:

a first housing part having at least one aperture therethrough;

a second housing part connected to the first housing part, wherein the first and second housing parts are adapted to capture a portion of a flat flex cable therebetween with a section of the flat flex cable having stripped regions being located at the at least one aperture, wherein the stripped regions are located on a first side of the cable facing outward at the at least one aperture; and at least one elastic element connected to the second housing part, wherein the at least one elastic element comprises a metal member with at least one spring strip sized and shaped to be located between the first and second housing proximate the at least one aperture, wherein the at least one elastic element is adapted to contact an opposite side of the flat flex cable and push the cable outward into the at least one aperture.

16. Electrical connection components as in claim 15 wherein the first housing part is pivotably connected to the second housing part.

17. Electrical connection components as in claim 15 wherein the second housing part comprises at least one opening at a portion of the at least one elastic element to allow a housing of an electrical component, which the electrical connection components are adapted to be at least partially inserted into, to press against the at least one elastic element.

18. Electrical connection components as in claim 15 wherein the at least one elastic element comprises a comb with spring steel strips parallel to one another.

19. Electrical connection components as in claim 15 wherein the spring steel strips comprise bent back free ends.

* * * * *